US009240309B2

(12) United States Patent
Bonner et al.

(10) Patent No.: US 9,240,309 B2
(45) Date of Patent: Jan. 19, 2016

(54) SYSTEMS AND METHODS FOR ACQUIRING DATA FOR MASS SPECTROMETRY IMAGES

(71) Applicant: DH TECHNOLOGIES DEVELOPMENT PTE. LTD., Singapore (SG)

(72) Inventors: Ronald F. Bonner, Newmarket (CA); Stephen A. Tate, Barrie (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/427,559

(22) PCT Filed: Sep. 13, 2013

(86) PCT No.: PCT/IB2013/001996

§ 371 (c)(1),
(2) Date: Mar. 11, 2015

(87) PCT Pub. No.: WO2014/045093

PCT Pub. Date: Mar. 27, 2014

(65) Prior Publication Data

US 2015/0248999 A1 Sep. 3, 2015

Related U.S. Application Data

(60) Provisional application No. 61/702,370, filed on Sep. 18, 2012.

(51) Int. Cl.
*H01J 49/00* (2006.01)
*H01J 49/16* (2006.01)

(52) U.S. Cl.
CPC ..... *H01J 49/0045* (2013.01); *H01J 49/0004* (2013.01); *H01J 49/0027* (2013.01); *H01J 49/164* (2013.01); *H01J 49/165* (2013.01)

(58) Field of Classification Search
CPC ... H01J 49/0045; H01J 49/165; H01J 49/164; H01J 49/0004; H01J 49/0027
USPC ..... 250/281, 282, 288
See application file for complete search history.

(56) References Cited

U.S. PATENT DOCUMENTS

2005/0116162 A1 6/2005 Vestal
2013/0240723 A1* 9/2013 Bonner ..... H01J 49/04 250/282

FOREIGN PATENT DOCUMENTS

JP 2006-093160 A 4/2006
JP 2008-130401 A 6/2008
JP 2009-158106 A 7/2009

OTHER PUBLICATIONS

International Search Report and Written Opinion for PCT/IB2013/001996, mailed Feb. 28, 2014.

*Primary Examiner* — Michael Maskell
(74) *Attorney, Agent, or Firm* — John R. Kasha; Kelly L. Kasha; Kasha Law LLC

(57) ABSTRACT

Systems and methods are provided for maximizing the data acquired from a sample in a mass spectrometry imaging experiment. An ion source device is instructed to produce and transmit to a tandem mass spectrometer a plurality of ions for each location of two or more locations of a sample. A mass range is divided into two or more mass window widths. For each location of the two or more locations, the tandem mass spectrometer is instructed to fragment the plurality of ions received for each location using each mass window width of the two or more mass window widths and to analyze resulting product ions. A product ion spectrum is produced for each mass window width, and a plurality of product ion spectra are produced for each location of the two or more locations.

20 Claims, 4 Drawing Sheets

100

SYSTEMS AND METHODS FOR ACQUIRING DATA FOR MASS SPECTROMETRY IMAGES

CROSS REFERENCE TO RELATED APPLICATION

This application claims the benefit of U.S. Provisional Patent Application Ser. No. 61/702,370, filed Sep. 18, 2012, the content of which is incorporated by reference herein in its entirety.

INTRODUCTION

Imaging mass spectrometry (IMS) or mass spectrometry imaging (MSI) has become an important analytical technique that has been broadly utilized within a number of fields. Its utilization is prominent in materials analysis and it has been utilized for diverse applications from metals characterization to biochemistry. It has been growing in importance, especially for the analysis of tissues and other biological samples. By generating an analyte map of a surface, valuable information about how a certain organism uses a given analyte can be obtained and visualized.

Thus far imaging data has been collected in one of several modes. These modes include, but are not limited to full scan mass spectrometry (MS), product ion scan mass spectrometry/mass spectrometry (MS/MS), and multiple reaction monitoring (MRM).

Full scan MS allows molecular ions to be located but does not provide the specificity needed for quantitation or provide the MS/MS data for identifying compounds or confirming their identity. Product ion scan MS/MS provides the MS/MS data for more specific quantitation and compound identification, but can only be applied to a limited number of predetermined compounds. MRM provides good quantitative data, but for a limited number of preselected compounds. As a result, there is currently, no acquisition method for MSI that provides data that can be used to quantitate or identify all of the compounds present in a sample.

Further, MSI speed is limited in that the time required to collect data far exceeds that needed for data processing. Classical imaging MS utilizes matrix-assisted laser desorption/ionization (MALDI), which requires fast scanning times due to the destruction of the sample by the laser.

SUMMARY

A system is disclosed for maximizing the data acquired from a sample in a mass spectrometry imaging experiment. In various embodiments, the system includes an ion source device, a tandem mass spectrometer, and a processor in communication with the ion source device and the tandem mass spectrometer that instructs the ion source device to produce and transmit to the tandem mass spectrometer a plurality of ions for each location of two or more locations of a sample, divides a mass range into two or more mass window widths, and for each location of the two or more locations, instructs the tandem mass spectrometer to fragment the plurality of ions received for the each location using each mass window width of the two or more mass window widths and to analyze resulting product ions, producing a product ion spectrum for each mass window width and a plurality of product ion spectra for each location of the two or more locations.

A method is disclosed for maximizing the data acquired from a sample in a mass spectrometry imaging experiment. In various embodiments, an ion source device is instructed to produce and transmit to a tandem mass spectrometer a plurality of ions for each location of two or more locations of a sample using a processor. A mass range is divided into two or more mass window widths using the processor. For each location of the two or more locations, the tandem mass spectrometer is instructed to fragment the plurality of ions received for the each location using each mass window width of the two or more mass window widths and to analyze resulting product ions using the processor, producing a product ion spectrum for each mass window width and a plurality of product ion spectra for each location of the two or more locations.

A computer program product is disclosed that includes a non-transitory and tangible computer-readable storage medium whose contents include a program with instructions being executed on a processor so as to perform a method for maximizing the data acquired from a sample in a mass spectrometry imaging experiment. In various embodiments, the method includes providing a system, wherein the system comprises one or more distinct software modules, and wherein the distinct software modules comprise an imaging module and a sequential acquisition module. In various embodiments, the imaging module instructs an ion source device to produce and transmit to a tandem mass spectrometer a plurality of ions for each location of two or more locations of a sample. The sequential acquisition module divides a mass range into two or more mass window widths. For each location of the two or more locations, the sequential acquisition module instructs the tandem mass spectrometer to fragment the plurality of ions received for the each location using each mass window width of the two or more mass window widths and to analyze resulting product ions, producing a product ion spectrum for each mass window width and a plurality of product ion spectra for each location of the two or more locations.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
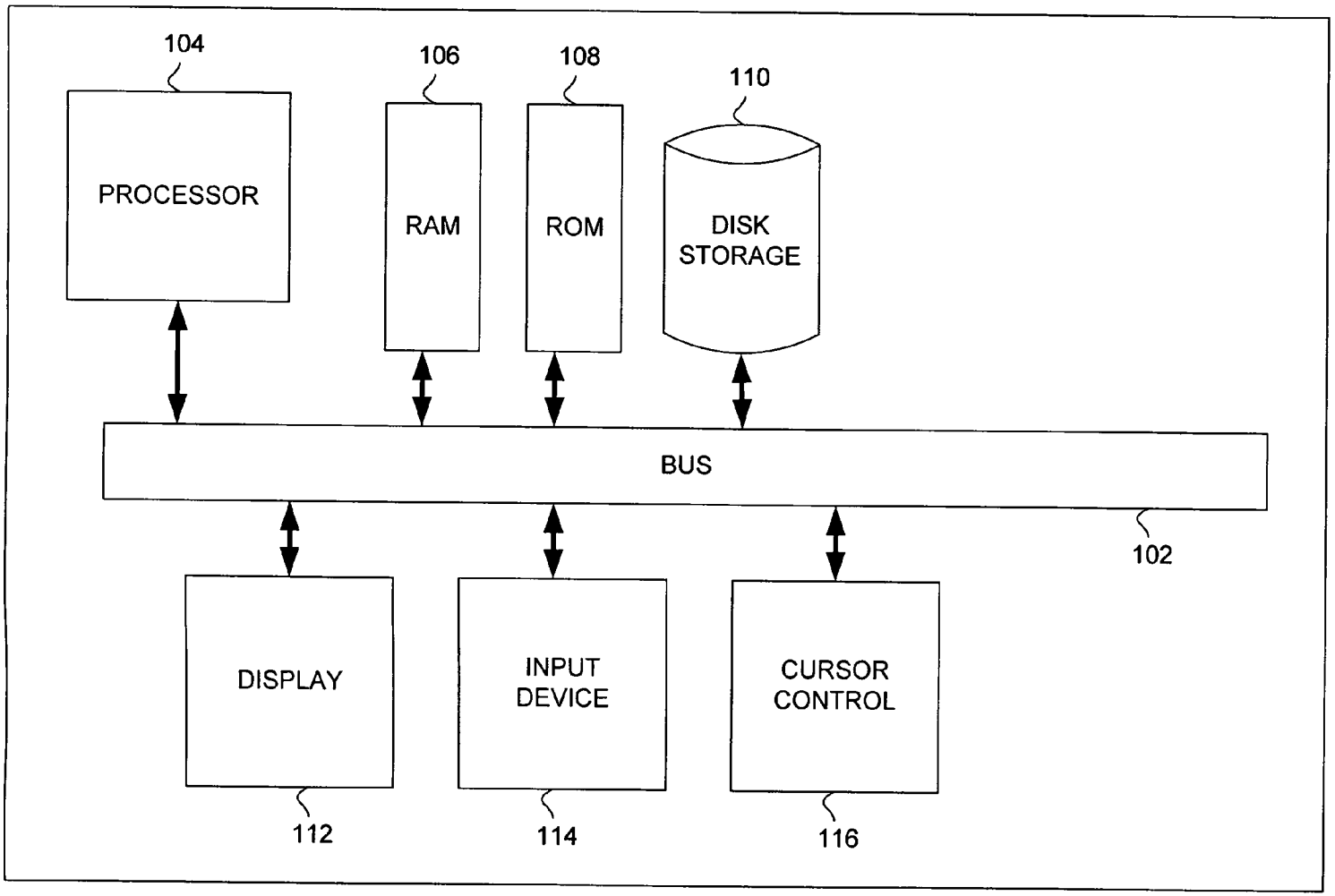
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods of MSI Data Acquisition

As described above, there is currently no acquisition method for mass spectrometry imaging (MSI) that provides data that can be used to provide both qualitative and quantitative information within the time required to collect data.

Both qualitative and quantitative information can be obtained from a tandem mass spectrometer. In such an instrument a precursor ion is selected in a first mass analyzer, fragmented and the fragments analyzed in a second analyzer or in a second scan of the first analyzer. The fragment ion spectrum can be used to identify the molecule and the intensity of one or more fragments can be used to quantitate the amount of the compound present in a sample.

Selected reaction monitoring (SRM) is a well-known example of this where a precursor ion is selected, fragmented, and passed to a second analyzer which is set to transmit a single ion. A response is generated when a precursor of the selected mass fragments to give an ion of the selected fragment mass, and this output signal can be used for quantitation. The instrument may be set to measure several fragment ions for confirmation purposes or several precursor-fragment combinations to quantitate different compounds.

The sensitivity and specificity of the analysis are affected by the width of the mass window selected in the first mass analysis step. Wide windows transmit more ions giving increased sensitivity, but may also allow ions of different mass to pass; if the latter give fragments at the same mass as the target compound interference will occur and the accuracy will be compromised.

In some mass spectrometers the second mass analyzer can be operated at high resolution, allowing the fragment ion window to be narrow so that the specificity can, to a large degree, be recovered. These instruments may also detect all fragments so they are inherently detecting different fragments. With such an instrument it is feasible to use a wide window to maximize sensitivity.

These recently developed high-resolution and high-throughput instruments allow a mass range to be accurately scanned within a time interval using multiple scans with adjacent or overlapping mass window widths. The collection of each spectrum at each time interval is a collection of spectra for the entire mass range. One exemplary method for using windowed mass spectrometry scans to scan an entire mass range is called sequential windowed acquisition (SWATH).

In various embodiments, SWATH is used to provide both qualitative and quantitative information within the time required to collect data in MSI. As a result, all of the available data from a sample can be collected in a single MSI experiment. In other words, SWATH allows the maximum amount of MSI information to be collected before a sample is exhausted.

SWATH involves, for example, fragmenting all ions within wide windows that are scanned across a mass range of interest, and analyzing the ions by extracting fragments of interest from the appropriate window. This allows fragments to be generated for all precursor ions in a given mass range so that any selected compound of interest can be located and quantitated. Although the technique is potentially applicable to standard spot-based matrix-assisted laser desorption/ionization (MALDI) analysis, the ability to extract useful information is enhanced by multiple spectra so that "chromatograms" can be generated, i.e., image analysis and LC-MALDI.

SWATH can include an untargeted acquisition followed by targeted processing. In MSI, the processing displays the location(s) of any peptide selected from a library, a lipid, etc. There is no limit to the number of compounds (of any molecular weight) that can be located or quantitated in this way, as long as the precursor mass is known (to determine the correct window) and some fragments are known (or predicted) for determining the location. Performing the analyses on an instrument capable of generating high resolution product ion spectra allows quantitation with specificity comparable to multiple reaction monitoring (MRM), but for any compound of interest.

Benefits for this form of analysis include a complete map commensurate with the sample consumption in a MALDI analysis. It also allows for the complete analysis of a sample and does not require a reanalysis if another compound of interest is found post analysis.

SWATH can be used in conjunction with any MSI ionization method. Conventionally, MSI is performed with an ionization source that is under vacuum, such as MALDI or secondary ion mass spectrometry (SIMS).

A class of atmospheric-pressure ionization sources for mass spectrometry, collectively termed ambient mass spectrometry (AMS), have been developed and shown to be well suited for MSI. One example of sampling at atmospheric-pressure includes a recently developed infrared MALDI (AP-IR-MALDI) for MSI. Another method for MSI of an atmospheric-pressure sample is the use of desorption electrospray ionization (DESI). Another technique, termed laser ablation electrospray ionization (LAESI), requires no sample pretreatment, can operate at atmospheric-pressure, and offers the potential of depth information.

Another MSI ionization method is liquid extraction surface analysis (LESA). LESA provides the benefits of nanoelectrospray/mass spectrometry to surface analysis and automates surface sampling for faster, more effective analysis.

Although a number of MSI ionization methods are described above, one skilled in the art will appreciate that other methods of MSI ionization can equally be used in conjunction with SWATH.

SWATH-MSI System

Figure 2:
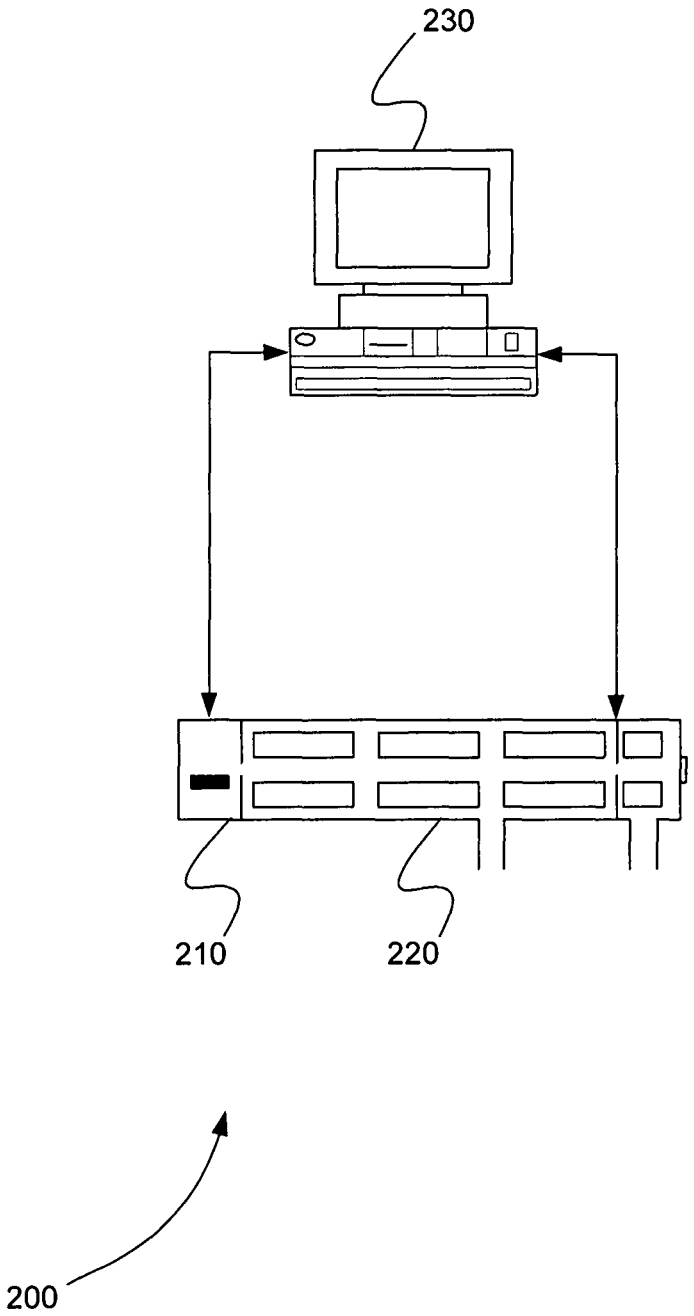
FIG. 2 is a schematic diagram showing a system for maximizing the data acquired from a sample in a mass spectrometry imaging experiment, in accordance with various embodiments.

FIG. 2 is a schematic diagram showing a system 200 for maximizing the data acquired from a sample in an MSI experiment, in accordance with various embodiments. System 200 includes ion source device 210, tandem mass spectrometer 220, and processor 230. Ion source device 210 can use any MSI ionization method. MSI ionization methods can include, but are not limited to, MALDI, LESA, SIMS, DESI, and LAESI.

Tandem mass spectrometer 220 can include one or more physical mass analyzers that perform two or more mass analyses. A mass analyzer of a tandem mass spectrometer can include, but is not limited to, a time-of-flight (TOF), quadrupole, an ion trap, a linear ion trap, an orbitrap, or a Fourier transform mass analyzer. Tandem mass spectrometer 220 can also include a separation device (not shown). The separation device can perform a separation technique that includes, but is not limited to, liquid chromatography, gas chromatography, capillary electrophoresis, or ion mobility. Tandem mass spectrometer 220 can include separating mass spectrometry stages or steps in space or time, respectively.

Processor 230 can be, but is not limited to, a computer, microprocessor, or any device capable of sending and receiving control signals and data from tandem mass spectrometer 220 and processing data. Processor 230 is in communication with ion source device 210 and tandem mass spectrometer 220.

Processor 230 instructs ion source device 210 to produce and transmit to the tandem mass spectrometer a plurality of ions for each location of two or more locations on a sample. Processor 230 divides a mass range into two or more mass window widths. For each location of the two or more locations, processor 230 instructs tandem mass spectrometer 220 to fragment the plurality of ions received for each location using each mass window width of the two or more mass window widths and to analyze the resulting product ions. As a result, a product ion spectrum is produced for each mass window width and a plurality of product ion spectra are produced for each location of the two or more locations.

In various embodiments, processor 230 further both identifies and quantifies a compound for each location of the two or more locations using a plurality of product ion spectra for each location of the two or more locations. The identification and quantification can occur after acquisition of ions at each location of the two or more locations.

SWATH-MSI Method

Figure 3:
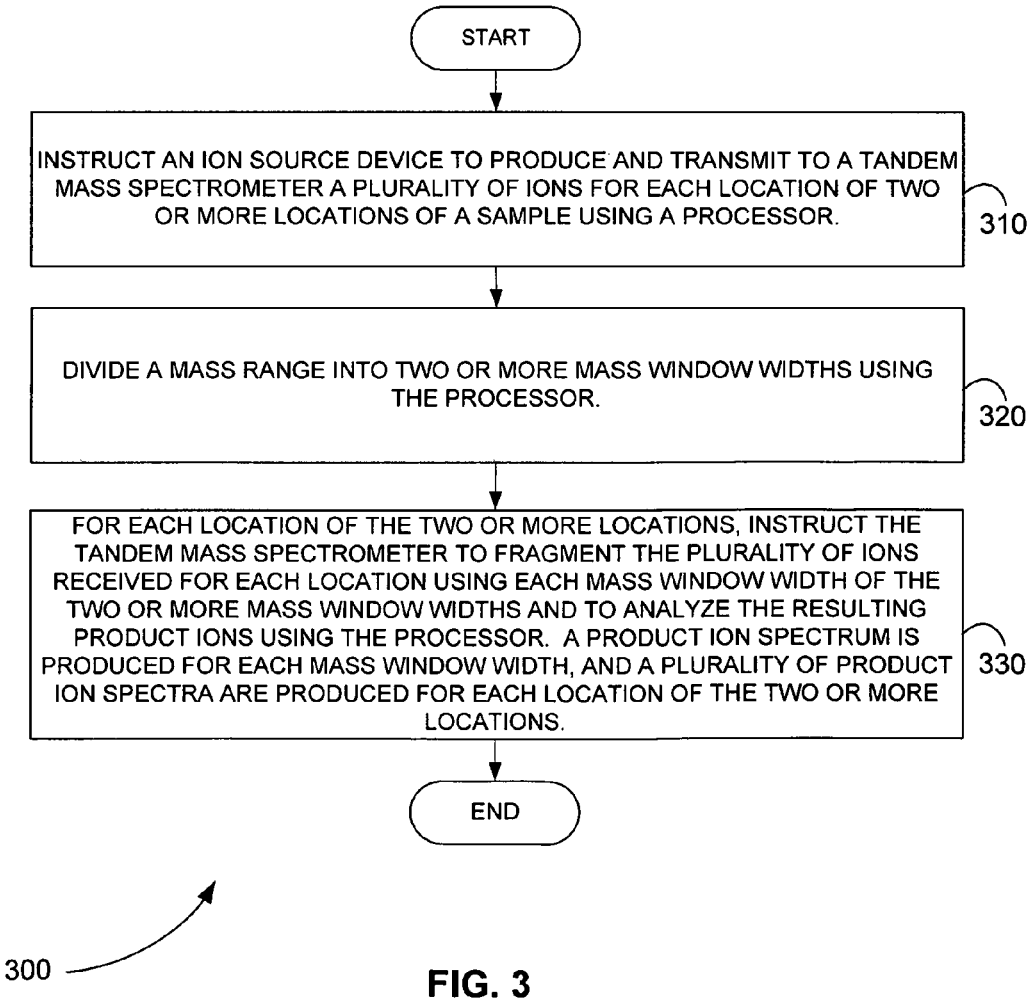
FIG. 3 is an exemplary flowchart showing a method for maximizing the data acquired from a sample in a mass spectrometry imaging experiment, in accordance with various embodiments.

FIG. 3 is an exemplary flowchart showing a method 300 for maximizing the data acquired from a sample in an MSI experiment, in accordance with various embodiments.

In step 310 of method 300, an ion source device is instructed to produce and transmit to a tandem mass spectrometer a plurality of ions for each location of two or more locations of a sample using a processor.

In step 320, a mass range is divided into two or more mass window widths using the processor.

In step 330, for each location of the two or more locations, the tandem mass spectrometer is instructed to fragment the plurality of ions received for each location using each mass window width of the two or more mass window widths and to analyze resulting product ions using the processor. A product ion spectrum is produced for each mass window width, and a plurality of product ion spectra are produced for each location of the two or more locations.

SWATH-MSI Computer Program Product

In various embodiments, a computer program product includes a tangible computer-readable storage medium whose contents include a program with instructions being executed on a processor so as to perform a method for maximizing the data acquired from a sample in an MSI experiment. This method is performed by a system that includes one or more distinct software modules.

Figure 4:
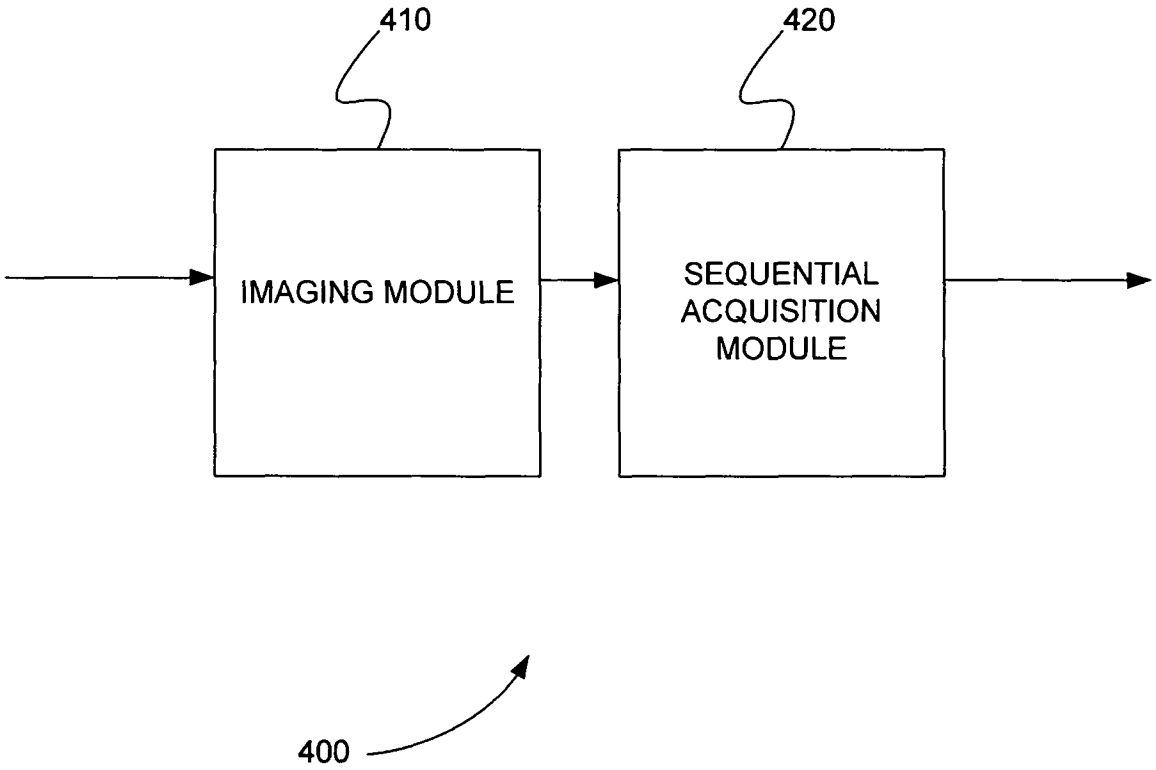
FIG. 4 is a schematic diagram of a system that includes one or more distinct software modules that performs a method for maximizing the data acquired from a sample in a mass spectrometry imaging experiment, in accordance with various embodiments.

FIG. 4 is a schematic diagram of a system 400 that includes one or more distinct software modules that performs a method for maximizing the data acquired from a sample in an MSI experiment, in accordance with various embodiments. System 400 includes imaging module 410 and sequential acquisition module 420.

Imaging module 410 instructs an ion source device to produce and transmit to a tandem mass spectrometer a plurality of ions for each location of two or more locations of a sample.

Sequential acquisition module 420 divides a mass range into two or more mass window widths. For each location of the two or more locations, Sequential acquisition module 420 instructs the tandem mass spectrometer to fragment the plurality of ions received for the each location using each mass window width of the two or more mass window widths and to analyze resulting product ions. A product ion spectrum is produced for each mass window width, and a plurality of product ion spectra are produced for each location of the two or more locations.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for maximizing the data acquired from a sample in a mass spectrometry imaging experiment, comprising:

an ion source device;

a tandem mass spectrometer; and a processor in communication with the ion source device and the tandem mass spectrometer that instructs the ion source device to produce and transmit to the tandem mass spectrometer a plurality of ions for each location of two or more locations of a sample, divides a mass range into two or more mass window widths, and for each location of the two or more locations, instructs the tandem mass spectrometer to fragment the plurality of ions received for the each location using each mass window width of the two or more mass window widths and to analyze resulting product ions, producing a product ion spectrum for each mass window width and a plurality of product ion spectra for each location of the two or more locations.

2. The system of claim 1, wherein the ion source device performs matrix-assisted laser desorption/ionization (MALDI).

3. The system of claim 1, wherein the ion source device performs liquid extraction surface analysis (LESA).

4. The system of claim 1, wherein the ion source device performs one of secondary ion mass spectrometry (SIMS), desorption electrospray ionization (DESI), or laser ablation electrospray ionization (LAESI).

5. The system of claim 1, wherein the two or more locations are two or more discrete spots on the sample.

6. The system of claim 1, wherein the two or more locations are two or more raster lines on the sample.

7. The system of claim 1, wherein the processor further both identifies and quantifies a compound for each location of the two or more locations using a plurality of product ion spectra for each location of the two or more locations after acquisition of ions at each location of the two or more locations.

8. A method for maximizing the data acquired from a sample in a mass spectrometry imaging experiment, comprising:

instructing an ion source device to produce and transmit to a tandem mass spectrometer a plurality of ions for each location of two or more locations of a sample using a processor;

dividing a mass range into two or more mass window widths using the processor; and for each location of the two or more locations, instructing the tandem mass spectrometer to fragment the plurality of ions received for the each location using each mass window width of the two or more mass window widths and to analyze resulting product ions using the processor, producing a product ion spectrum for each mass window width and a plurality of product ion spectra for each location of the two or more locations.

9. The method of claim 8, wherein the ion source device performs matrix-assisted laser desorption/ionization (MALDI).

10. The method of claim 8, wherein the ion source device performs liquid extraction surface analysis (LESA).

11. The method of claim 8, wherein the ion source device performs one of secondary ion mass spectrometry (SIMS), desorption electrospray ionization (DESI), or laser ablation electrospray ionization (LAESI).

12. The method of claim 8, wherein the two or more locations are two or more discrete spots on the sample.

13. The method of claim 8, wherein the two or more locations are two or more raster lines on the sample.

14. The method of claim 8, further comprising identifying and quantifying a compound for each location of the two or more locations using a plurality of product ion spectra for each location of the two or more locations after acquisition of ions at each location of the two or more locations using the processor.

15. A computer program product, comprising a non-transitory and tangible computer-readable storage medium whose contents include a program with instructions being executed on a processor so as to perform a method for maximizing the data acquired from a sample in a mass spectrometry imaging experiment, the method comprising:

providing a system, wherein the system comprises one or more distinct software modules, and wherein the distinct software modules comprise an imaging module and a sequential acquisition module;

instructing an ion source device to produce and transmit to a tandem mass spectrometer a plurality of ions for each location of two or more locations of a sample using the imaging module;

dividing a mass range into two or more mass window widths using the sequential acquisition module; and for each location of the two or more locations, instructing the tandem mass spectrometer to fragment the plurality of ions received for the each location using each mass window width of the two or more mass window widths and to analyze resulting product ions using the sequential acquisition module, producing a product ion spectrum for each mass window width and a plurality of product ion spectra for each location of the two or more locations.

16. The computer program product of claim 15, wherein the ion source device performs matrix-assisted laser desorption/ionization (MALDI).

17. The computer program product of claim 15, wherein the ion source device performs liquid extraction surface analysis (LESA).

18. The computer program product of claim 15, wherein the ion source device performs one of secondary ion mass spectrometry (SIMS), desorption electrospray ionization (DESI), or laser ablation electrospray ionization (LAESI).

19. The computer program product of claim 15, wherein the two or more locations are two or more discrete spots on the sample.

20. The computer program product of claim 15, wherein the two or more locations are two or more raster lines on the sample.

* * * * *